US008342110B2

(12) United States Patent
Cerliani

(10) Patent No.: US 8,342,110 B2
(45) Date of Patent: Jan. 1, 2013

(54) ROTARY HOOK FOR A LOCKSMITH SEWING MACHINE, COMPRISING MEANS TO REDUCE THE NOISE THEREOF

(76) Inventor: Daniele Cerliani, Pavia (IT)

( * ) Notice: Subject to any disclaimer, the term of this patent is extended or adjusted under 35 U.S.C. 154(b) by 578 days.

(21) Appl. No.: 12/625,616

(22) Filed: Nov. 25, 2009

(65) Prior Publication Data

US 2010/0126399 A1 May 27, 2010

(30) Foreign Application Priority Data

Nov. 25, 2008 (IT) ..... MI2008A2105

(51) Int. Cl.
*D05B 57/14* (2006.01)

(52) U.S. Cl. ..... 112/231

(58) Field of Classification Search ..... 112/185, 112/192, 189, 196, 231, 232, 220, 228, 181
See application file for complete search history.

(56) References Cited

U.S. PATENT DOCUMENTS

| | | | | |
|---|---|---|---|---|
| 3,943,866 | A * | 3/1976 | Bogaert | 112/228 |
| 4,429,649 | A | 2/1984 | Eguchi et al. | |
| 4,530,296 | A | 7/1985 | Takenoya et al. | |
| 4,577,572 | A | 3/1986 | Hirose | |
| 4,638,751 | A | 1/1987 | Hanyu et al. | |
| 4,704,975 | A | 11/1987 | Hara et al. | |
| RE32,809 | E | 12/1988 | Hirose | |
| 7,171,914 | B2 * | 2/2007 | Ota et al. | 112/231 |

FOREIGN PATENT DOCUMENTS

| | | |
|---|---|---|
| EP | 0 489 980 A1 | 6/1992 |
| EP | 1 640 490 A1 | 3/2006 |
| WO | WO 00/36201 A2 | 6/2000 |

OTHER PUBLICATIONS

Italian Search Report dated Oct. 15, 2009.
European Search Report in Corresponding application No. EP 09 17 6587 dated Mar. 29, 2010.

* cited by examiner

*Primary Examiner* — Tejash Patel
(74) *Attorney, Agent, or Firm* — Young & Thompson

(57) ABSTRACT

A rotary hook of a lockstitch sewing machine includes at least one hook body including a cylindrical cavity and a basket freely rotatable in the cylindrical cavity, to which it is constrained by a rib, provided on the outer surface of the basket, which engages in a C-shaped race, provided in the inner wall of the cylindrical cavity of the hook body and delimited by two plane surfaces parallel to each other and by a cylindrical surface perpendicular to the plane ones, suitable to prevent axial and radial translation of the basket in the cylindrical cavity—further includes elements applying to the basket an axial pressure causing the rib of the basket to lean against one of the plane surfaces delimiting the race present in the cylindrical cavity of the hook body. Some of these elements are carried by the lockstitch sewing machine to which the rotary hook belongs.

20 Claims, 6 Drawing Sheets

ROTARY HOOK FOR A LOCKSMITH SEWING MACHINE, COMPRISING MEANS TO REDUCE THE NOISE THEREOF

The present invention refers to a rotary hook for a lockstitch sewing machine, both for home and for industrial use, which comprises means to reduce the noise thereof.

The invention further refers to a lockstitch sewing machine comprising means to reduce the noise of a rotary hook and to a method for reducing the noise of a rotary hook.

The rotary hook can be of the type with a horizontal axis of rotation or of the type with a vertical axis of rotation.

Lockstitch sewing machines and the associated rotary hooks are well known and therefore will not be described herein, where it will merely be recalled that the rotary hook comprises at least one hook body, which is connected to a shaft from which it receives motion and which comprises a cylindrical cavity, a basket free to rotate inside the cylindrical cavity of the hook body, a gib which helps to constrain the basket to the hook body and possibly a bobbin case which is placed inside the basket and which helps to constrain the bobbin to the basket.

The shaft can be integral with the hook body or housed in a hole present in the centre of the cylindrical cavity.

The basket is constrained to the hook body by a rib, formed on the outer surface thereof, which engages in a race, formed in the inner wall of the cylindrical cavity of the hook body, which prevents an axial and a radial translation of the basket with respect to the cylindrical cavity, but not a rotation thereof.

This race of the hook body consists of a C-shaped groove delimited by two plane surfaces parallel to each other and by a cylindrical surface perpendicular to the plane ones.

The race of the hook body and the rib of the basket must be interrupted for a certain angular sector to allow the needle thread to pass and the stitch to be formed: these interruptions prevent the use of bearings, making necessary a coupling of the sliding type (or with sliding friction) between the race of the hook body and the rib of the basket and also causing, during the rotation of the hook body, noise (due to the play existing between the rib of the basket and the race of the hook body and to the fact that they are habitually made of metal materials) which is enhanced by vibration and resonance phenomena.

In the current state of the art, it is not possible to eliminate said play and the causes of the noise are so interdependent with each other that they cannot be identified with certainty or eliminated by adopting suitable geometric shapes and/or by imposing more restrictive dimensional or surface tolerances, which would in any case increase the production cost of the rotary hook.

U.S. Pat. No. 7,171,914 (or EP 1640490) describes a hook with a vertical axis in which the basket and the hook body are made of synthetic material (synthetic resins) and the basket is constrained to the hook body by magnetic elements inserted in the bottom wall of the basket and on the bottom of the cylindrical cavity of the hook body, allowing the structure of the hook to be simplified (for example, the gib and C-shaped race formed in the inner wall of the cylindrical cavity of the hook body are not provided) and the production costs thereof to be reduced.

U.S. Pat. No. 4,429,649 discloses a rotary hook for home sewing machines where the basket (called bobbin case holder) is constrained by a rib, provided on the outer surface of the basket, which engages in a L-shaped race, provided in the inner wall of the cylindrical cavity of the hook body and delimited by only one plane surface and by a cylindrical surface perpendicular to the plane one, suitable to prevent merely the radial translation of the basket in the cylindrical cavity.

Said basket is free to fluctuate in axial direction and a magnet positioned at the bottom of the cylindrical cavity of the hook body provides to adjust the tension of the lower thread.

EP 0 489 980 refers to a magnet placed on the bobbin case (called "bobbin holding mechanism") to adhere the same to the basket (called "bobbin case holder"): the magnet does not influence the basket in relation to the hook body.

U.S. Pat. No. 4,577,572 describes a rotary hook in which, to reduce the friction between the rib of the basket and the race of the hook body, the rib of the basket is made to "float" in the race of the hook body by means of a cushion of air. The reduction in friction leads to a reduction in the thread tension necessary for stitching and to a reduction in wear on parts.

U.S. Pat. No. 32,809 describes a rotary hook in which, to reduce the friction between the rib of the basket and the race of the hook body, the rib of the hook body is made to "float" in the race of the hook body by means of a magnetic bearing. The reduction in friction leads to a reduction in the thread tension necessary for stitching and to a reduction in wear on parts.

Object of the present invention is to provide a rotary hook comprising means suitable to reduce the noise thereof within negligible noise limits with respect to the noise of the sewing machine; in particular, an object of the present invention is to provide a rotary hook whose noise is less than 45 db even in cases in which, in the absence of the above means, the noise of said hook would exceed 68 db.

This object has been achieved by means of the rotary hook of independent claim 1, which comprises means suitable to apply to the basket an axial pressure which obliges the rib of the basket to lean against one of the two plane surfaces of the race present in the cylindrical cavity of the hook body, instead of vibrating freely in said race because of the play always present between said rib and said race.

This axial pressure has the effect of stabilising the basket, preventing vibration and resonance thereof.

Further advantageous characteristics form the subject matter of the dependent claims.

In previously cited U.S. Pat. No. 7,171,914 (or EP 1640490) magnets are used to constrain to the hook body a basket made of synthetic material, which would otherwise be free to float, because of the simplification of the hook structure (L-shaped race instead of C-shaped race and related absence of the gib). This invention does not concern the problem of the noise in that, by using a basket and a hook body of synthetic material, the noise produced during the rotation of the hook body is already per se minimal.

In previously cited U.S. Pat. No. 4,429,649 a magnet is used to adjust the tension of the lower thread. Also this patent, as the previously cited U.S. Pat. No. 7,171,914, refers to a hook with a L-shaped race.

In previously cited EP 0 489 980 a magnet is used to adhere the bobbin case to the basket, but the magnet does not influence the basket in relation to the hook body and cannot influence the noise produced.

In previously cited U.S. Pat. Nos. 4,577,572 and 32,809 magnets or air jets are used to reduce the friction between the rib of the basket and the race of the hook body and, consequently, to reduce the thread tension necessary for stitching and the wear on parts.

In the present invention, said friction tends to be increased and stabilised, by pushing the basket towards a plane surface of the race of the hook body in order to reduce the vibrations (and therefore the noise) of the rotary hook as much as possible.

An advantage of the rotary hook according to the present invention consists in the fact that it can be applied to all existing sewing machines without having to modify their stitching members and, in the majority of its embodiments, without requiring any modification to a sewing machine available on the market.

Furthermore, a rotary hook made according to the invention is completely interchangeable with a rotary hook of the prior art, does not require any modification of the areas destined for the passage of the thread and, in the majority of its embodiments, in itself contains all the constructional features necessary to implement the invention.

The invention will now be described with reference to exemplifying but non limiting embodiments, described in the appended figures, wherein:

In the appended figures, corresponding elements will be identified by like reference numerals.

FIG. 1 shows diagrammatically an exploded view of a rotary hook 1 with a horizontal axis of rotation, known to the art, in which only the elements relevant to the present description have been identified by reference numerals:

Figure 1:
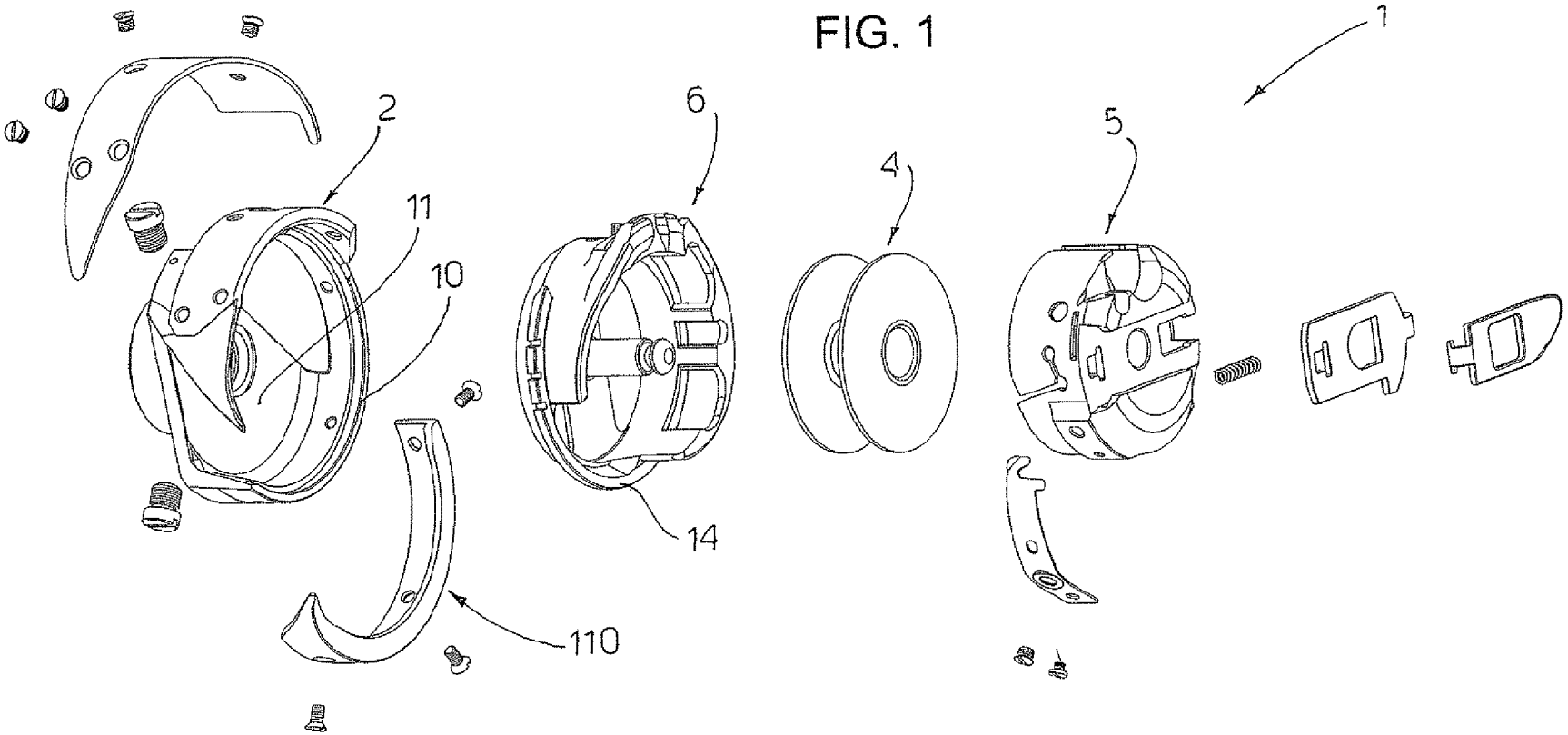
FIG. 1 shows diagrammatically an exploded view of a rotary hook of the prior art.

- a hook body 2, comprising a cylindrical cavity 11 which, in the example shown, has a central hole 17 (FIG. 2) suitable to receive a shaft (omitted for the sake of simplicity of the graphic representation) from which the hook 1 receives motion; in a different embodiment, the shaft is integral with the hook 1 (see FIGS. 3 and 10);
- a basket 6, free to rotate inside the cylindrical cavity 11 to which it is constrained by a rib 14 formed on the outer surface of the basket 6,
- a C-shaped race 10, formed in the inside wall of the cylindrical cavity 11 of the hook body 2 and delimited by two plane surfaces parallel with each other (one of which is partially formed by the gib 110) and by a cylindrical surface perpendicular to the plane ones, in which the rib 14 of the basket 6 engages with a small amount of play (from about 0.01 mm to about 0.1 mm) to prevent an axial and a radial translation of the basket 6 in the cylindrical cavity 11;
- a bobbin 4, carried by the basket 6 or possibly by a bobbin case 5 set inside the basket 6.

Figure 2:
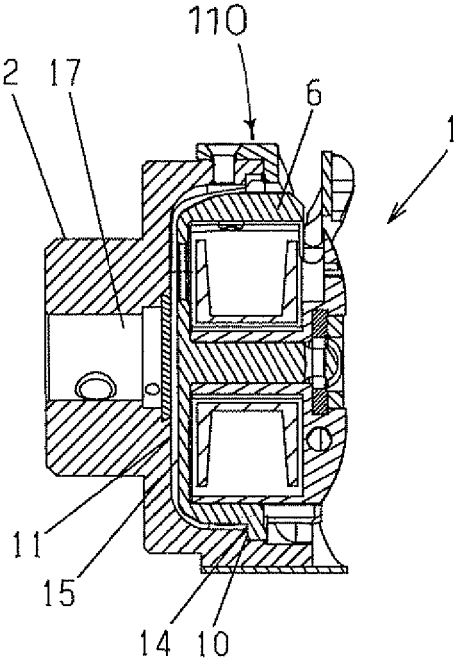
FIG. 2 shows diagrammatically the rotary hook of FIG. 1 assembled and sectioned along a plane passing through its axis of rotation.
Figure 3:
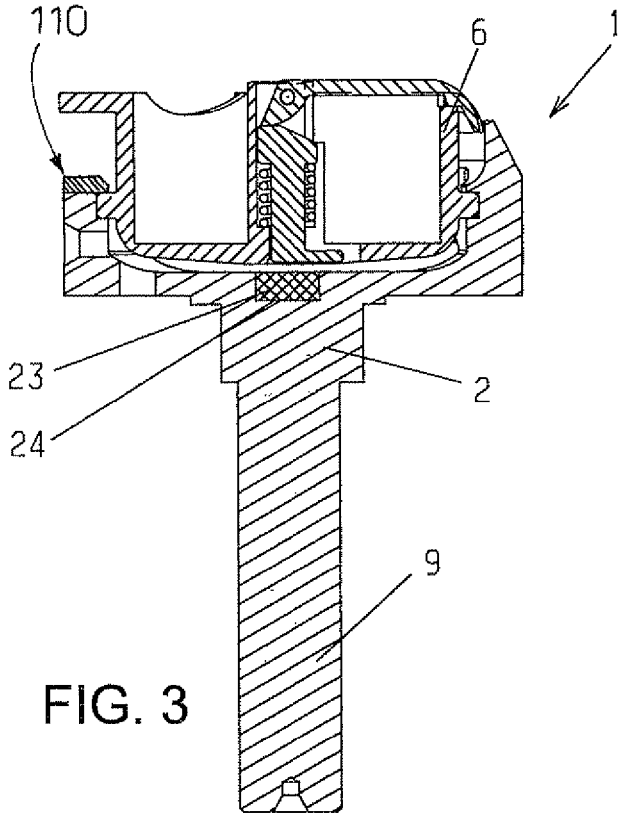
FIGS. 3-16 show diagrammatically various embodiments of a rotary hook according to the invention, in which magnetic means are provided to reduce noise.
Figure 4:
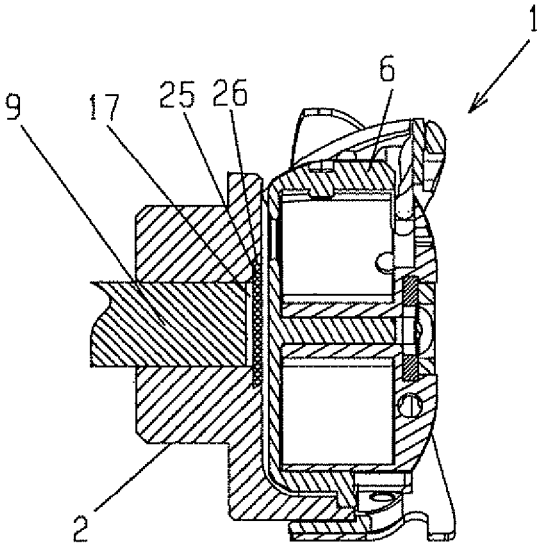
Figure 5:
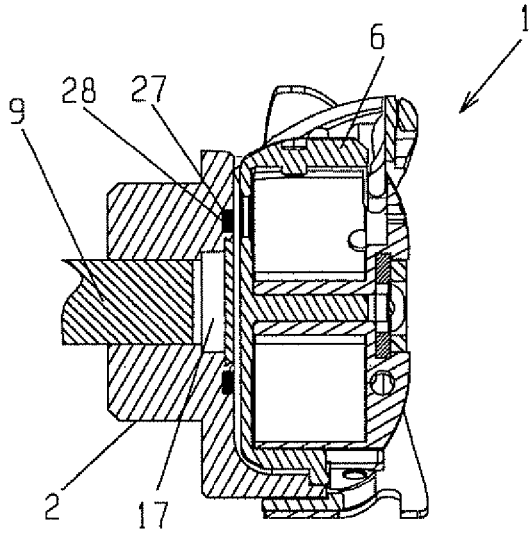
Figure 6:
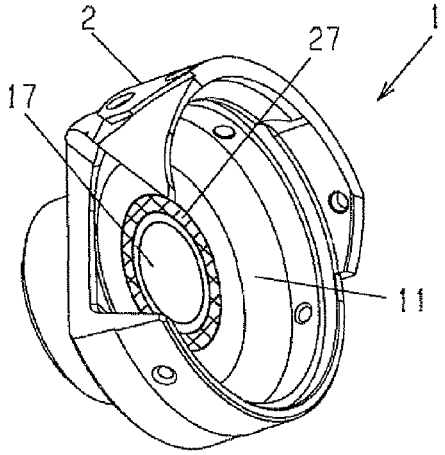
Figure 10:
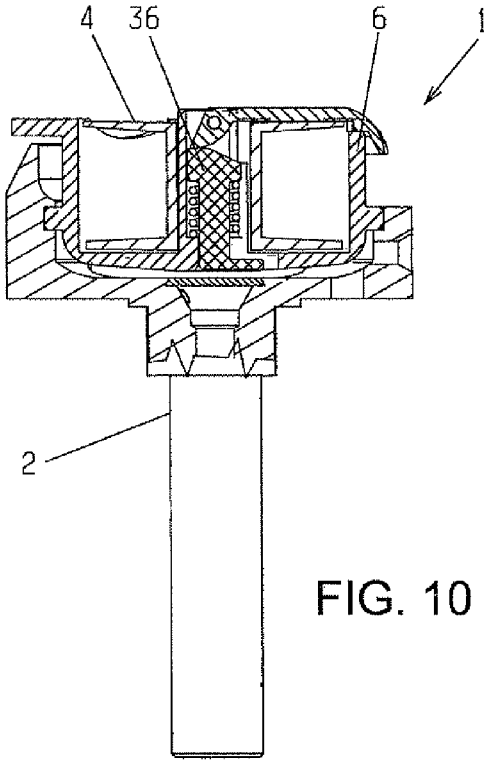
Figure 11:
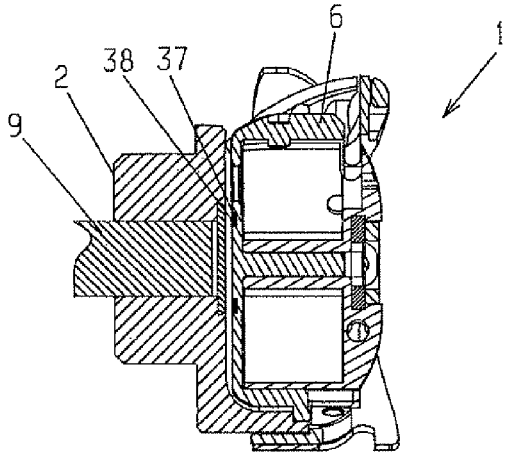
Figure 12:
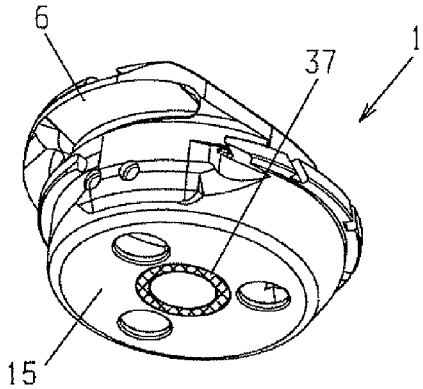

FIG. 2 shows diagrammatically the rotary hook 1 of FIG. 1 assembled and sectioned through a plane passing through its axis of rotation; visible in FIG. 2 are the hook body 2 comprising the cylindrical cavity 11, the rib 14 of the basket 6, the race 10 of the hook body in which the rib 14 of the basket 6 is engaged, the bottom wall 15 of the basket 6 and the central hole 17 of the cylindrical cavity 11 able to accommodate a shaft (omitted for the sake of simplicity of the graphic representation) from which the hook 1 receives motion; in a different embodiment, on the other hand, the shaft is integral with the hook 1 (see FIGS. 3 and 10).

The rotary hook 1 according to the present invention comprises means suitable to apply an axial pressure on the basket 6 such as to cause the rib 14 of the basket 6 to lean against one of the plane surfaces delimiting the race 10 present in the cylindrical cavity 11 of the hook body 2.

The axial pressure is preferably created by applying to the basket 6 a force of not more than 50 grams (0.49 N).

Figure 14:
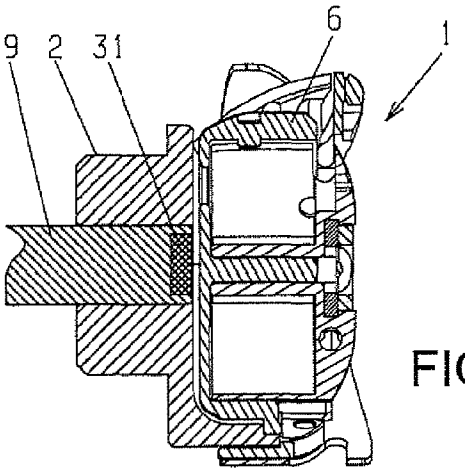
Figure 16:
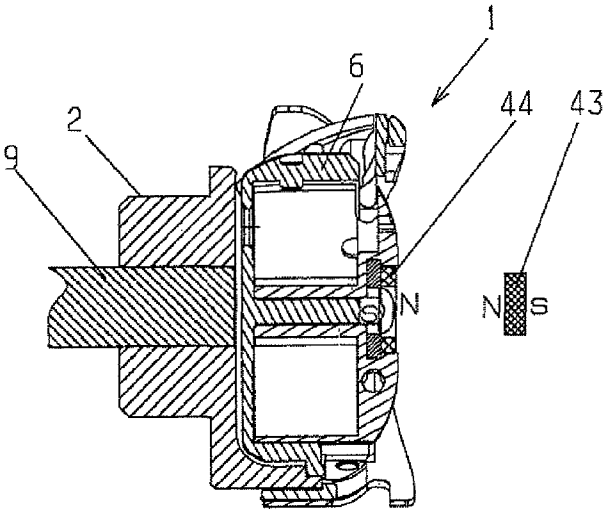

In a preferred embodiment of a rotary hook 1 according to the invention, schematically described in FIGS. 3-16, the means able to apply said axial pressure to the basket 6 comprise at least one magnetic element, which can:

A) be fixed with respect to the hook body 2, attract the basket 6 (which is metal and therefore ferromagnetic) and consist of:

A.1) a disk-shaped magnet 23, set in a blind recess 24 provided on the bottom of the cylindrical cavity 11 of the hook body 2, as shown in FIG. 3, where the shaft 9 is fixed with respect to the hook body 2, or else of A.2) a disk-shaped magnet 25, set in a recess 26 provided on the bottom of the cylindrical cavity 11 of the hook body 2 to close a central hole 17 in which the shaft 9 is housed (FIG. 4), or, in a different embodiment of the rotary hook 1, to close the central hole of the lubrication system (represented, for example, in FIG. 10) or else of A.3) a ring-shaped magnet 27, set in a circular recess 28 provided on the bottom of the cylindrical cavity 11 of the hook body 2 and concentric to the axis of rotation of the hook body 2 (FIGS. 5, 6), the circular recess 28 not modifying the central hole 17, if any, of the hook body 2, or else of A.4) a series of cylindrical magnets 29, set in a series of blind recesses 30 or of through holes set at regular intervals on the bottom of the cylindrical cavity 11 of the hook body 2 and suitable to develop a constant force having axial symmetry with respect to the rotation axis of the hook body (FIG. 7), the blind recesses 30 or the through holes not modifying the central hole 17, if any, of the hook body 2;

B) be fixed with respect to the basket 6, attract the basket 6 towards the hook body 2 or the shaft 9 (which are metal and therefore ferromagnetic) and consist of:

B.1) a disk-shaped magnet 32 set in a blind recess 33 provided in the bottom wall 15 of the basket 6 and aligned with the axis of the basket 6 (FIG. 8), or else of B.2) a magnetic post 35 set aligned with the basket 6 (FIG. 9), the post 35 also serving for braking the bobbin 4 to prevent undesired rotations thereof, or else of B.3) a magnetic extractor 36 (if the basket 6 has an extractor) set aligned with the axis of the basket 6 (FIG. 10), the magnetic extractor 36 also serving for braking the bobbin 4 to prevent undesired rotations thereof, or else of B.4) a ring-shaped magnet 37, set in a circular recess 38 formed in the bottom wall 15 of the basket 6 and aligned with the axis of the basket 6 (FIGS. 11, 12), or else of B.5) a series of cylindrical magnets 39, set in a series of blind recesses or through holes 41 set at regular intervals on the bottom wall 15 of the basket 6 and able to develop a constant force having axial symmetry with respect to the axis of the basket 6 (FIG. 13), the cylindrical magnets 39 also serving for braking the bobbin 4 to prevent undesired rotations thereof;

C) be fixed with respect to the shaft 9 and consist of a disk-shaped magnet 31, set on top of said shaft and aligned or slightly sunk with respect to the surface of the cylindrical cavity 11 of the hook body 2, which attracts the basket 6 (FIG. 14);

D) be set in the lockstitch sewing machine near the basket 6 or near the bobbin case 5 contained therein and consist of:

D.1) a magnet 42, which attracts the basket 6 or the bobbin case 5 contained therein (FIG. 15), or else of D.2) a first magnet 43, which interacts with a second magnet 44, mounted on the basket 6 or on the bobbin case 5 contained therein, which has a polarity of the same sign towards the first magnet 43 to repel the basket 6 from the first magnet 43 (FIG. 16).

Figure 17:
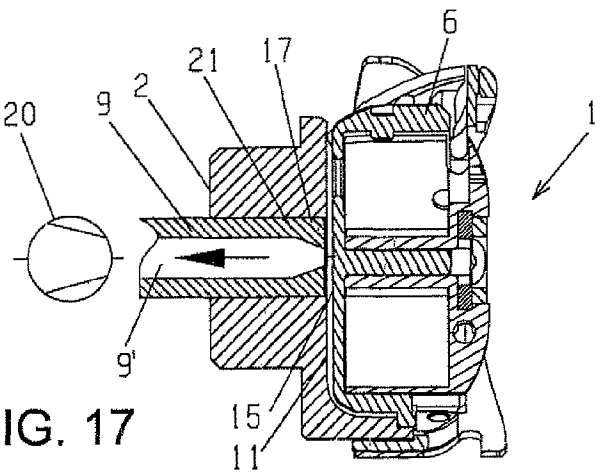
FIGS. 17-19 show diagrammatically three further embodiments of a rotary hook according to the invention, in which a depressurisation is used to reduce the noise.
Figure 18:
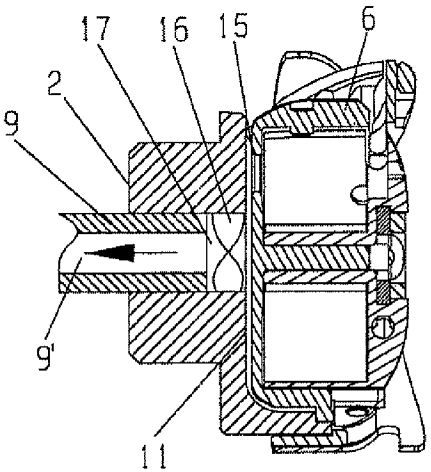
Figure 19:
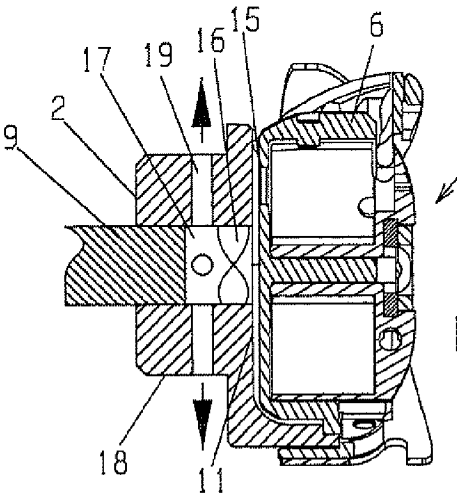

In other embodiments of a rotary hook 1 according to the invention, diagrammatically illustrated in FIGS. 17-19, the means suitable to apply to the axial pressure on the basket 6 are able to create a depressurisation between the bottom wall 15 of the basket 6 and the cylindrical cavity 11 of the hook body 2.

This "vacuum" effect sucks the basket 6 towards the hook body 2 and can be obtained by means of:

- a nozzle 21, set on the end of the shaft 9 and in communication with the cylindrical cavity 11 of the hook body 2, connected to a vacuum pump 20 by means of an axial hole 9' formed in the shaft 9 (FIG. 17); or else
- a fan 16, mounted in the central hole 17 of the hook body 2 (FIGS. 18 and 19) or on the end of the shaft 9, which is in communication with the cylindrical cavity 11 of the hook body 2 through said central hole 17 to suck the air from the cylindrical cavity 11.

The air sucked by the fan 16 can exit through the axial hole 9' of the shaft 9 (FIG. 18) or through radial holes 19 which connect the central hole 17 of the hook body 2 to the outer surface 18 of the hook body 2, also obtaining a centrifugal effect (FIG. 19).

In order to improve the "vacuum" effect, the apertures normally present on the sides of the cylindrical cavity 11, which serve to reduce the weight of the hook body 2 and to balance it, can be omitted.

Figure 20:
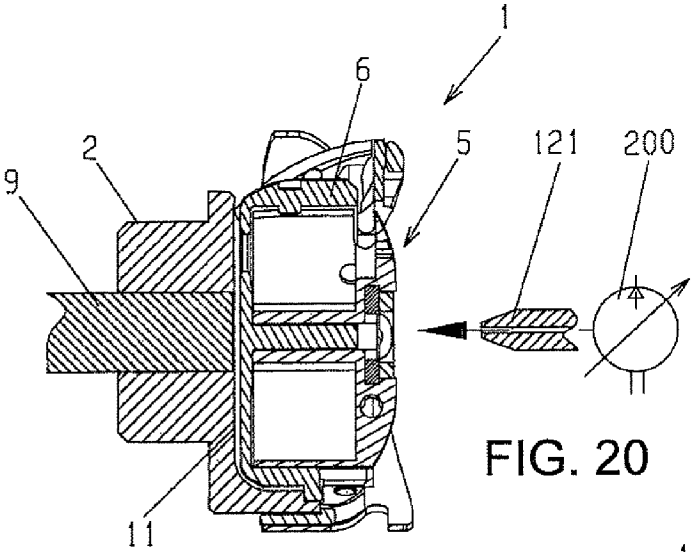
FIGS. 20 and 21 show diagrammatically two further embodiments of a rotary hook according to the invention, in which jets of air are used to reduce the noise.
Figure 21:
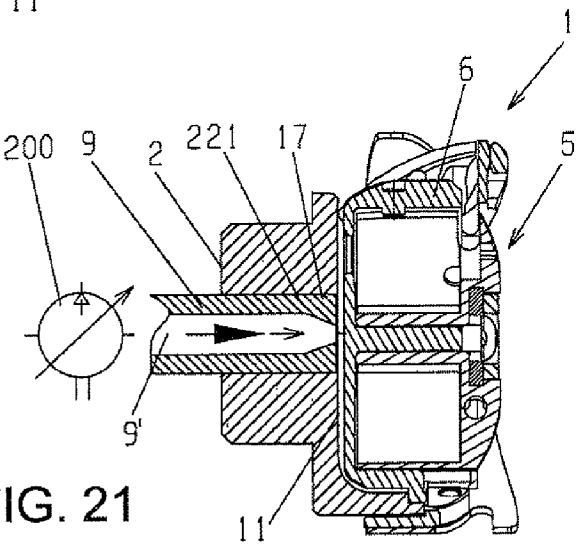

In a further embodiment of a rotary hook 1 according to the invention, diagrammatically described in FIGS. 20 and 21, the means suitable to apply the axial pressure to the basket 6 are suitable to convey onto the basket 6 or onto the bobbin case 5 contained therein a jet of compressed air in an axial direction with respect to the basket 6, by means of

- a nozzle 121, connected to a compressor 200, which sends a jet of compressed air onto the basket 6 in an axial direction (FIG. 20), or else
- a nozzle 221, set at the end of the shaft 9 in communication with the cylindrical cavity 11 of the hook body 2 and connected to the compressor 200 by means of an axial hole 9' provided in the shaft 9 (FIG. 21).

Obviously, the invention is not limited to the particular embodiments previously described and illustrated in the appended figures, but numerous modifications of detail within the reach of a person skilled in the art can be made thereto, without thereby departing from the scope of the invention, as set forth in the appended claims.

The invention claimed is:

1. Rotary hook (1) for a lockstitch sewing machine, comprising at least a hook body (2), in turn comprising a cylindrical cavity (11) and a basket (or bobbin case holder) (6), which is free to rotate inside the cylindrical cavity (11) of the hook body (2) to which it is constrained by a rib (14), provided on the outer surface of the basket (6), which engages with play in a C-shaped race (10), provided in the inner wall of the cylindrical cavity (11) of the hook body (2) and delimited by two plane surfaces parallel to each other and by a cylindrical surface perpendicular to said plane surfaces, to prevent the axial and radial translation of the basket (6) in the cylindrical cavity (11), the hook body (2) being connected to a shaft (9) from which it receives motion, said rotary hook (1) being characterized by comprising means (23; 25; 27; 29; 32; 35; 36; 37; 39; 31; 16; 21; 121; 221; 20; 200) applying an axial pressure on the basket (6) to cause the rib (14) of the basket (6) to lean against one of said two plane surfaces delimiting the C-shaped race (10) of the hook body (2) to reduce the noise of the rotary hook (1) caused by the vibration of the basket due to said play.

2. Rotary hook (1) as per claim 1, characterized in that said means (23; 25; 27; 29; 32; 35; 36; 37; 39; 31) suitable to apply an axial pressure on the basket (6) comprise at least one magnetic element.

Figure 7:
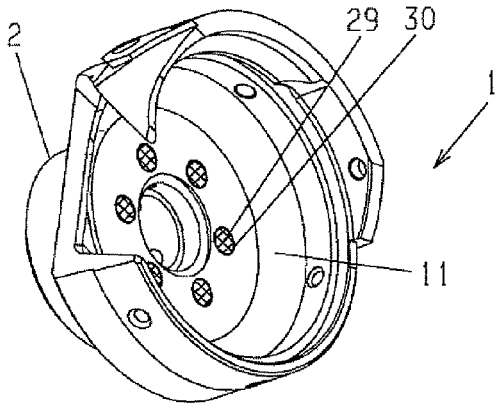
Figure 8:
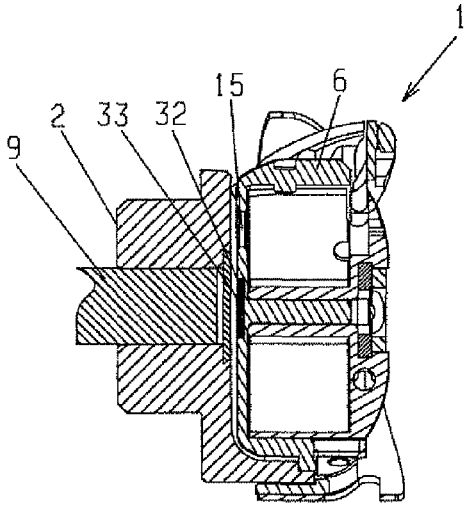
Figure 9:
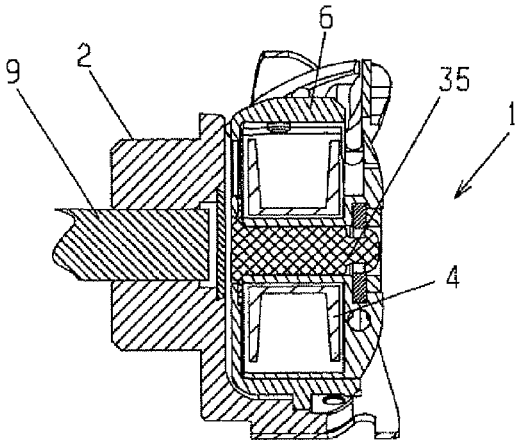

3. Rotary hook (1) as per claim 2, characterized in that said at least one magnetic element (23, 25, 27, 29) is fixed with respect to the hook body (2), attracts the basket (6) and comprises:

- a disk-shaped magnet (23) set in a recess (24) provided on the bottom of the cylindrical cavity (11) of the hook body (2) (FIG. 3); or
- a disk-shaped magnet (25), set in a recess (26) provided on the bottom of the cylindrical cavity (11) of the hook body (2) to close a central hole (17) in which the shaft (9) is housed (FIG. 4) or a central hole of the lubrication system; or
- a ring-shaped magnet (27) set in a circular recess (28) provided on the bottom of the cylindrical cavity (11) of the hook body (2) and centred on the rotation axis of the hook body (2) (FIGS. 5, 6); or
- a plurality of cylindrical magnets (29) set in a plurality of recesses (30) or of through holes set at regular intervals on the bottom of the cylindrical cavity (11) of the hook body (2) and suitable to develop a constant force having axial symmetry with respect to the rotation axis of the hook body (2) (FIG. 7).

Figure 13:
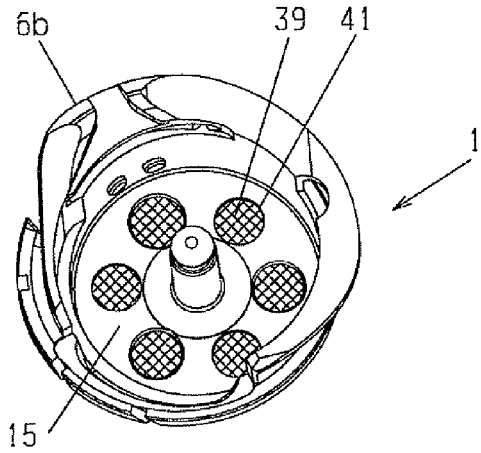
Figure 15:
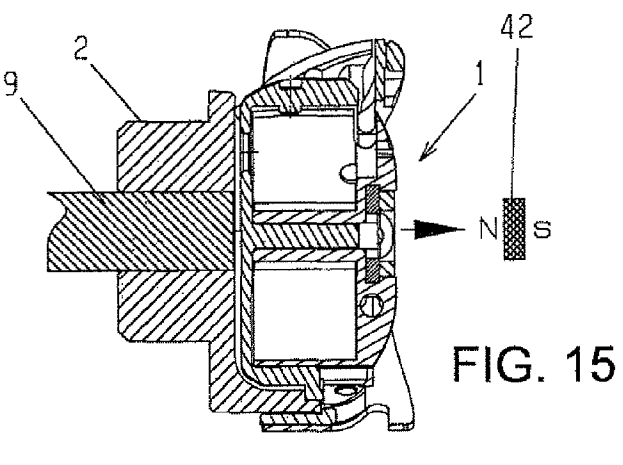

4. Rotary hook (1) as per claim 2, characterized in that said at least one magnetic element (32, 35, 36, 37, 39) is fixed with respect to the basket (6), attracts the basket (6) towards the bottom of the cylindrical cavity (11) of the hook body (2) and comprises:

- a disk-shaped magnet (32), set in a recess (33) provided in the bottom wall (15) of the basket (6) and aligned with the axis of the basket (6) (FIG. 8); or
- a magnetic post (35), set aligned with the axis of the basket (6), said magnetic post (35) being also suitable to brake the bobbin (4) to prevent undesired rotations thereof (FIG. 9); or
- a magnetic extractor (36), set aligned with the axis of the basket (6), said magnetic extractor (36) being also suitable to brake the bobbin (4) to prevent undesired rotations thereof (FIG. 10); or
- a ring-shaped magnet (37), set in a circular recess (38) made in the bottom wall (15) of the basket (6) and aligned with the axis of the basket (6) (FIGS. 11, 12); or
- a plurality of cylindrical magnets (39), set in a plurality of recesses or of through holes (41), which are set at regular intervals in the bottom wall (15) of the basket (6) and which are able to develop a constant force having axial symmetry with respect to the axis of the basket (6), said cylindrical magnets (39) being also suitable to brake the bobbin (4) to prevent undesired rotations thereof (FIG. 13).

5. Rotary hook (1) as per claim 2, characterized in that said at least one magnetic element consists of a magnet (31), fixed with respect to the shaft (9) of the hook body (2) and set on top of said shaft, which attracts the basket (6) (FIG. 14).

6. Rotary hook (1) as per claim 1, characterized in that the means (16, 20; 21) suitable to apply an axial pressure on the basket (6), are means suitable to create a depressurisation between the bottom wall (15) of the basket (6) and the cylindrical cavity (11) of the hook body (2).

7. Rotary hook (1) as per claim 6, characterized in that the means suitable to create the depressurisation between the bottom wall (15) of the basket (6) and the cylindrical cavity (11) consist of a nozzle (21), set on the end of the shaft (9) and in communication with the cylindrical cavity (11) of the hook body (2), connected to a vacuum pump (20) through the axial hole (9') of the shaft (9) (FIG. 17).

8. Rotary hook (1) as per claim 6, characterized in that said means suitable to create a depressurisation between the bottom wall (15) of the basket (6) and the cylindrical cavity (11) consist of a fan (16) suitable to suck in air from the cylindrical cavity (11) of the hook body (2), the air sucked in by the fan (16) exiting through an axial hole (9') made in the shaft (9) or through radial holes (19) that connect a central hole (17) of the hook body (2) to the outer surface (18) of the hook body (2) (FIGS. 18, 19).

9. Rotary hook (1) as per claim 1, characterized in that the means (121; 200; 221) suitable to apply an axial pressure on the basket (6) are means suitable to convey onto the basket (6) or onto the bobbin case (5) contained therein, a jet of compressed air in axial direction with respect to the basket (6), and comprises:

- a nozzle (121), connected to a compressor (200), which sends a jet of compressed air onto the basket (6) in axial direction (FIG. 20); or
- a nozzle (221), set at the end of the shaft (9) in communication with the cylindrical cavity (11) of the hook body (2) and connected to a compressor (200) by means of an axial hole (9') provided in the shaft (9) (FIG. 21).

10. Lockstitch sewing machine comprising means for reducing the noise of a rotary hook (1) as per claim 1.

11. Lockstitch sewing machine comprising magnetic means for reducing the noise of a rotary hook (1) by applying an axial pressure on the basket (6) of the rotary hook (1) to cause a rib (14) of the basket (6) to lean against one of two plane surfaces, parallel each other, delimiting a C-shaped race (10) provided in the inner wall of the rotary hook body (2), said magnetic means comprising:

- a magnet (42) set in the lockstitch sewing machine, which attracts the basket (6) or the bobbin case (5) contained therein (FIG. 15); or
- a first magnet (43) set in the lockstitch sewing machine, which interacts with a second magnet (44) mounted on the basket (6) or on the bobbin case (5) contained therein, the second magnet (44) having a polarity of the same sign towards said first magnet (43) (FIG. 16).

12. Method for reducing the noise of a rotary hook (1) as per claim 1, characterized in that applied on the basket (6) of the rotary hook (1) is an axial pressure suitable to cause the rib (14) of the basket (6) to lean against one of the plane surfaces delimiting the race (10) of the hook body (2).

13. Lockstitch sewing machine comprising means for reducing the noise of a rotary hook (1) as per claim 2.

14. Lockstitch sewing machine comprising means for reducing the noise of a rotary hook (1) as per claim 3.

15. Lockstitch sewing machine comprising means for reducing the noise of a rotary hook (1) as per claim 4.

16. Lockstitch sewing machine comprising means for reducing the noise of a rotary hook (1) as per claim 5.

17. Lockstitch sewing machine comprising means for reducing the noise of a rotary hook (1) as per claim 6.

18. Lockstitch sewing machine comprising means for reducing the noise of a rotary hook (1) as per claim 7.

19. Lockstitch sewing machine comprising means for reducing the noise of a rotary hook (1) as per claim 8.

20. Lockstitch sewing machine comprising means for reducing the noise of a rotary hook (1) as per claim 9.

* * * * *

UNITED STATES PATENT AND TRADEMARK OFFICE

CERTIFICATE OF CORRECTION

PATENT NO. : 8,342,110 B2
APPLICATION NO. : 12/625616
DATED : January 1, 2013
INVENTOR(S) : Daniele Cerliani It is certified that error appears in the above-identified patent and that said Letters Patent is hereby corrected as shown below:

On the Title Page, Item (54) and in the Specification, Column 1, Title should read:
--ROTARY HOOK FOR A LOCKSTITCH SEWING MACHINE, COMPRISING MEANS TO REDUCE THE NOISE THEREOF--

Signed and Sealed this
Twenty-sixth Day of March, 2013

Teresa Stanek Rea
*Acting Director of the United States Patent and Trademark Office*